US008500298B2

(12) United States Patent
Ogawa et al.

(10) Patent No.: US 8,500,298 B2
(45) Date of Patent: Aug. 6, 2013

(54) LIGHTING FIXTURE

(75) Inventors: Kozo Ogawa, Yokosuka (JP); Kazunari Higuchi, Yokosuka (JP); Shigetoshi Komiyama, Yokosuka (JP); Takayoshi Moriyama, Tokosuka (JP); Shinichi Kumashiro, Yokosuka (JP)

(73) Assignees: Toshiba Lighting & Technology Corporation, Kanagawa (JP); Kabushiki Kaisha Toshiba, Tokyo (JP)

( * ) Notice: Subject to any disclaimer, the term of this patent is extended or adjusted under 35 U.S.C. 154(b) by 104 days.

(21) Appl. No.: 13/034,948

(22) Filed: Feb. 25, 2011

(65) Prior Publication Data

US 2011/0211346 A1 Sep. 1, 2011

(30) Foreign Application Priority Data

Feb. 26, 2010 (JP) ..... 2010-043238
Mar. 26, 2010 (JP) ..... 2010-073679

(51) Int. Cl.
*F21V 1/00* (2006.01)
*F21V 11/00* (2006.01)
*F21V 21/00* (2006.01)

(52) U.S. Cl.
USPC ..... 362/235; 362/249.01

(58) Field of Classification Search
USPC ..... 362/235, 249.01
See application file for complete search history.

(56) References Cited

U.S. PATENT DOCUMENTS 5,567,036 A * 10/1996 Theobald et al. ..... 362/485
6,249,375 B1 * 6/2001 Silhengst et al. ..... 359/362
6,499,870 B1 * 12/2002 Zwick et al. ..... 362/505
6,533,445 B1 * 3/2003 Rogers ..... 362/540
7,513,653 B1 4/2009 Liu
7,607,802 B2 * 10/2009 Kang et al. ..... 362/294
8,047,679 B2 * 11/2011 Wu et al. ..... 362/249.02
8,070,316 B2 * 12/2011 Urano et al. ..... 362/249.02
2009/0027889 A1 1/2009 Kang
2009/0046456 A1 * 2/2009 Urano et al. ..... 362/235
2009/0195186 A1 * 8/2009 Guest et al. ..... 315/294
2009/0290354 A1 * 11/2009 Moriyama et al. ..... 362/296.01
2010/0033969 A1 2/2010 Hochstein

FOREIGN PATENT DOCUMENTS

CN 2859203 1/2007
CN 2886314 4/2007
CN 101382242 9/2011
GB 2462815 2/2010
JP 2007-012966 1/2007

(Continued)

OTHER PUBLICATIONS

English Language Abstract of JP 2008-300207 published Dec. 11, 2008.

(Continued)

*Primary Examiner* — David J Makiya
(74) *Attorney, Agent, or Firm* — DLA Piper LLP

(57) ABSTRACT

According to one embodiment, a lighting fixture includes a fixture body and a plurality of light-emitting modules. A plurality of light-emitting module arrangement portions are formed on the surface of the fixture body. The light-emitting modules are arranged on the light-emitting module arrangement portions of the fixture body and annularly arranged so that a space is formed at the center area of the fixture body. Semiconductor light-emitting elements are disposed on the surface of the light-emitting module, and a wiring connector is arranged at the space side of the substrate.

7 Claims, 12 Drawing Sheets

FOREIGN PATENT DOCUMENTS

| | | |
|---|---|---|
| JP | 2008-186776 | 8/2008 |
| JP | 2008-300207 | 12/2008 |
| JP | 2009-277586 | 11/2009 |

OTHER PUBLICATIONS

English Language Translation of JP 2008-300207 published Dec. 11, 2008.
English Language Abstract of JP 2008-1867776 published Aug. 14, 2008.
English Language Translation of JP 2008-1867776 published Aug. 14, 2008.
Extended European Search Report issued in EP 11156021.5 on Jun. 16, 2011.
English Language Abstract of JP 2009-277586 published Nov. 26, 2009.
English Language Translation of JP 2009-277586 published Nov. 26, 2009.
Chinese Office Action issued in CN201110046942.X dated Nov. 27, 2012.
English Language Translation of Chinese Office Action issued in CN201110046942.X dated Nov. 27, 2012.
English Language Abstract of JP 2007-012966 published Jan. 18, 2007.
English Language Translation of JP 2007-012966 published Jan. 18, 2007.
English Language Abstract of CN 101382242 published Mar. 11, 2009.
English Language Abstract of CN 2859203 published Jan. 17, 2007.
English Language Abstract of CN 2886314 published Apr. 4, 2007.

* cited by examiner (a)

(b)

(a)

(b)

(a)

(b)

(a)

(b)

(a)

(b)

LIGHTING FIXTURE

INCORPORATION BY REFERENCE

The present invention claims priority under 35 U.S.C. §119 to Japanese Patent Application Nos. 2010-043238 and 2010-073679 filed on Feb. 26, 2010 and Mar. 26, 2010, respectively. The contents of these applications are incorporated herein by reference in their entirety.

FIELD

Embodiments described herein relate generally to a lighting fixture using a semiconductor light-emitting element as a light source.

BACKGROUND

Recently, in place of a filament bulb, alighting fixture has been commercialized which uses LEDs as a light source, each of which is a semiconductor light-emitting element having a long life and low power consumption. For example, alighting fixture is used in which a plurality of SMD (Surface Mount Device) type LEDs are concentrically mounted on a disc-shaped substrate having a diameter of approximately 60 mm at even intervals. In addition, a lighting fixture is used which uses light-emitting modules each of which a plurality of LED chips are mounted on a substrate in a matrix shape with use of COB (Chip On Board) technology.

With this type of lighting fixture, it has been increasingly demanded that the lighting fixture emit an increasingly larger amount of light. However, since a great number of SMD type LEDs are required to be used in the lighting fixture using the SMD type LEDs, the lighting fixture is upsized. In addition, although a large amount of light is easily emitted when the lighting fixture using light-emitting modules is used, in the case where only one light-emitting module is used for emitting a larger amount of light, heat generated from the light emitting modules is concentrated in one spot and heat radiation performance is lowered. In order to improve heat radiation performance, the heat radiation area must be increased but this also leads to the upsizing the lighting fixture. As described above, the lighting fixture must be upsized for emitting a large amount of light.

It is an object of the present invention to provide a small lighting fixture that emits a large amount of light.

DETAILED DESCRIPTION

A lighting fixture includes: a fixture body having a plurality of light-emitting module arrangement portions on the surface thereof; and a plurality of light-emitting modules each having a substrate on which a semiconductor light-emitting element and a wiring connector are disposed, and are arranged on the light-emitting module arrangement portion of the fixture body such that the light-emitting modules surround the center area of the fixture body and the wiring connectors face the center area.

Next, a first embodiment will be described with reference to FIGS. 1 to 8.

Figure 8:
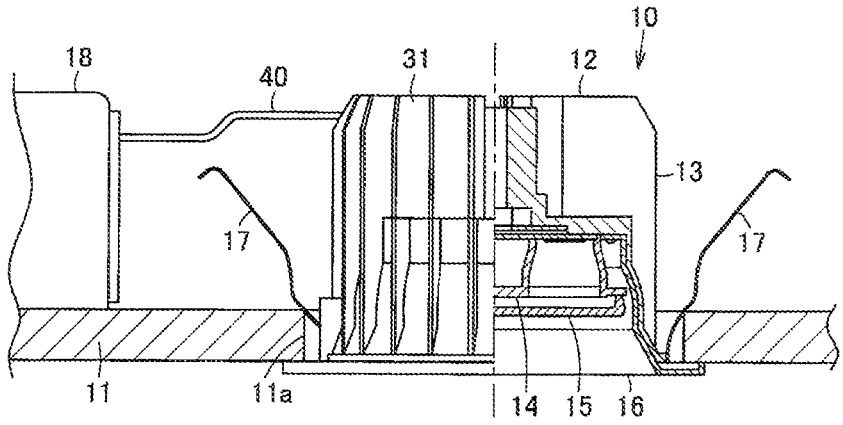
FIG. 8 is a cross sectional view of the set condition of the lighting fixture.

As shown in FIG. 8, a lighting fixture 10 is a downlight and embedded in an embedding hole 11*a* provided in a ceiling member 11 such as a ceiling board.

Figure 1:
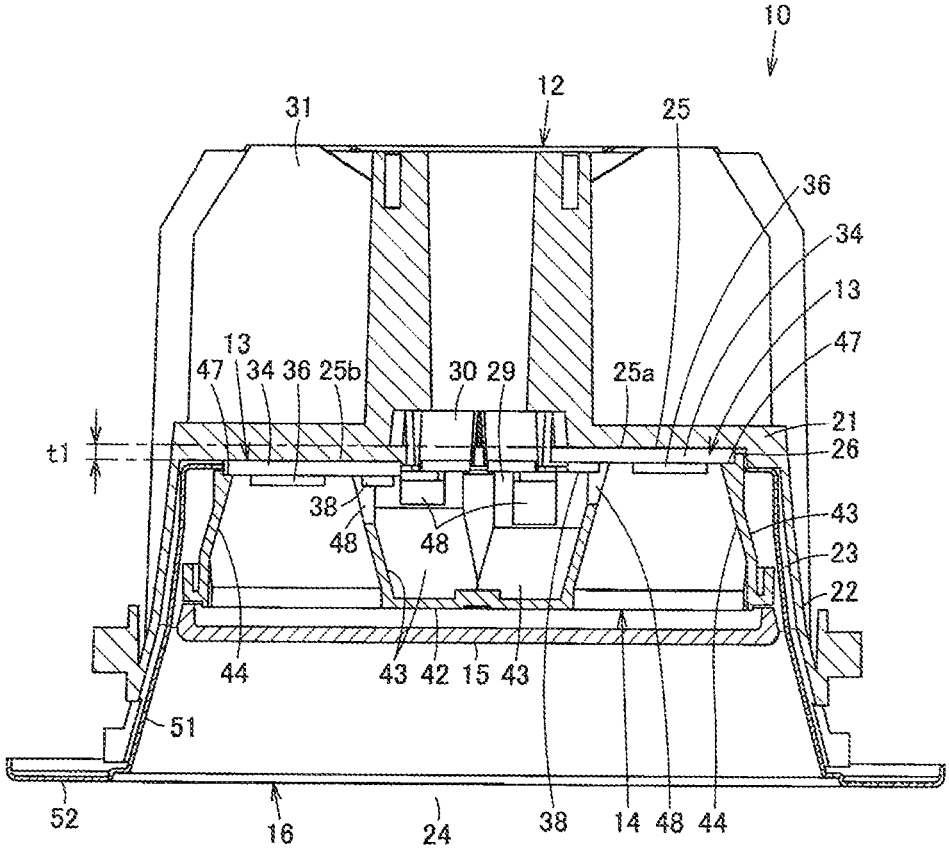
FIG. 1 is a cross sectional view of a lighting fixture of a first embodiment.
Figure 2:
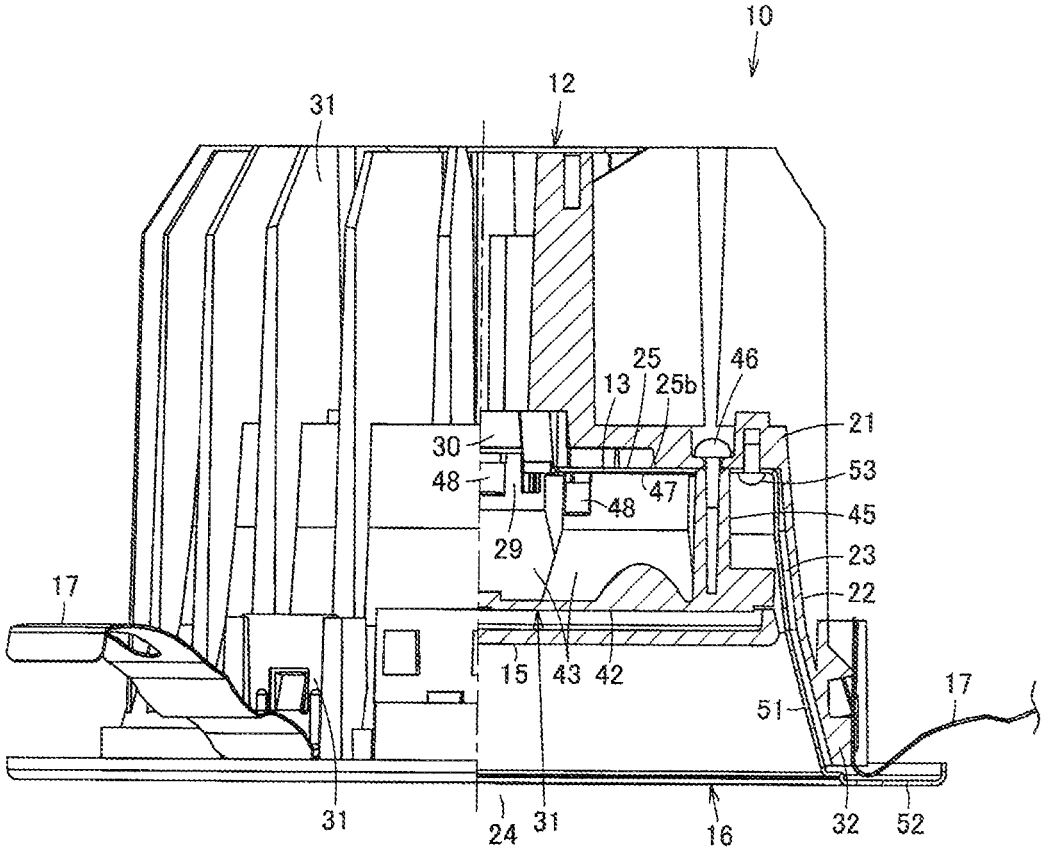
FIG. 2 is a side view of a partially cutaway lighting fixture.

As shown in FIGS. 1 and 2, the lighting fixture 10 includes: a fixture body 12, a plurality of light-emitting modules 13 arranged on a lower face, which is at the surface of the fixture body 12, a reflection body 14 which is arranged under the light-emitting modules 13 and attached to the fixture body 12, a light-transmissive cover 15 attached to a lower side of the refection body 14, a reflection frame 16 which covers the circumferences of the reflection body 14 and the light-transmissive cover 15 and is attached to the fixture body 12, a plurality of attachment springs 17 attached to an outer face of the fixture body 12, and a power source unit 18 which is arranged on the ceiling member 11 and supplies lighting power to the light-emitting modules 13.

Figure 3:
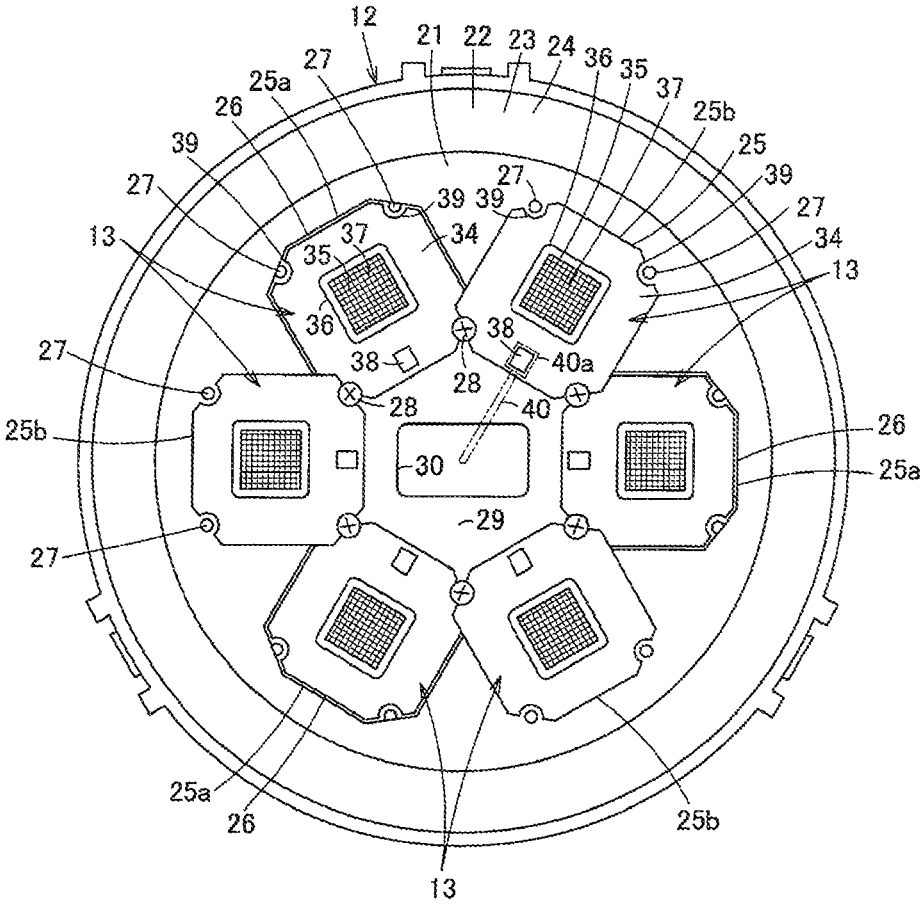
FIG. 3 is a bottom view of the lighting fixture in which light-emitting modules are arranged on a fixture body.

The fixture body 12 is formed of, for example, metal such as aluminum die casting, or ceramics excellent in thermal conductivity and heat radiation performance, and thus, as shown in FIGS. 1 to 3, serves as a heat radiating member for radiating heat generated from the light-emitting modules 13. The fixture body 12 has a circular substrate portion 21, a cylindrical portion 22 is formed of which an opening diameter becomes longer downward from a circumferential portion of the substrate portion 21, a housing portion 23 for housing the light-emitting modules 13, the reflection body 14, etc., is formed inside the cylindrical portion 22, and an opening portion 24 is formed in a lower face of the housing portion 23, that is, the lower face of the fixture body. Moreover, in the embodiment, the opening portion 24 of the fixture body 12 is approximately 135 mm in diameter.

A plurality of, for example, six light-emitting module arrangement portions 25, on which the light-emitting modules 13 are arranged, are circumferentially formed at even intervals at a circumferential portion of a lower face of the substrate portion 21. The light-emitting module arrangement portions 25 are divided into three inner-side light-emitting module arrangement portions 25*a* and three opening-side light-emitting module arrangement portions 25*b*, and the portions 25*a* and 25*b* are alternately arranged with level differences in the height direction. That is, the inner-side light-emitting module arrangement portion 25*a* is formed higher than, at a rear side when viewed from the opening portion 24 in relation to, the opening-side light-emitting module arrangement portion 25*b*, and the opening-side light-emitting module arrangement portion 25*b* is formed lower than, at a front side when viewed from the opening portion 24 in relation to, the inner-side light-emitting module arrangement portion 25*a*. The inner-side light-emitting module arrangement portion 25*a* is formed by a recessed portion 26 formed on the lower face of the substrate portion 21. The light-emitting module arrangement portions 25*a* and 25*b* are formed at a flat face, and the recess size of the recessed portion 26, that is, the size of a level difference t1, is the same as the thickness size of a substrate of the light-emitting module 13, for example, approximately 5 mm.

A pair of projections 27 as a positioning portion for positioning the light-emitting portion 13 is projectedly-arranged on an outer diameter side of each light-emitting module arrangement portion 25, and a pair of light-emitting module attachment screw holes (not shown) for fixing the light-emitting module 13 with screws 28 is formed in an inner diameter side thereof. Moreover, each light-emitting module screw hole is provided commonly with the adjacent light-emitting module arrangement portions 25, and thus the number of the screws 28 is six which is the same as that of the light-emitting modules 13.

A space 29 is formed at the center area of the lower face of the substrate portion 21, that is, the center among the light-emitting module arrangement portions 25.

A wiring hole 30 communicating with the space 29 is formed at the center area of the substrate portion 21, and a plurality of heat radiating fins 31 are radially formed on an upper side of the substrate portion 21.

A plurality of attachment spring attachment portions 32, to which the attachment springs 17 are attached, are provided at the circumference of the cylindrical portion 22.

In addition, the light-emitting modules 13 are the same, and each has a substantially rectangular substrate 34 formed of, for example, metal such as aluminum, or ceramics excellent in thermal conductivity, and a plurality of LED elements 35 as semiconductor light-emitting elements are arranged in a matrix shape on a surface which is the surface of the substrate 34. The plurality of LED elements 35 are connected to each other via a wiring pattern and bonded wires formed on the substrate 34 so that power can be supplied to the LED elements 35. A bank-shaped surrounding portion 36 for surrounding the plurality of LED elements 35 is formed, and a phosphor layer 37, with which the LED elements 35 are sealed and covered, is formed inside the surrounding portion 36. That is, the light-emitting module 13 is composed of a COB (Chip On Board) module. The LED elements 35 emit, for example, blue light, and the phosphor layer 37 is formed in a state that silicone resin containing a phosphor, which is excited by the blue light emitted from the LED elements 35 and mainly emits yellow light, is applied to the inside of the surrounding portion 36 or the surrounding portion 36 is filled with the silicone resin. Accordingly, white-based light obtained by mixing blue light with yellow light is emitted from a surface of the phosphor layer 37, and the surface of the phosphor layer 37 serves as a light-emitting surface. In the embodiment, the light-emitting surface is a square of which one side is approximately 15 mm in length.

A wiring connector 38 electrically connected to the plurality of LED elements 35 is mounted on the surface of the substrate 34. A plurality of connectors attached to the end of a cable which is led into the fixture body 12 from the power source unit 18 through the wiring hole 30, are connected to the connectors 38 of the light-emitting modules 13, and lighting power can be supplied from the power source unit 18 to each light-emitting module.

Nearly semicircular groove portions 39 are formed at four corners of the substrate 34.

In order to arrange the light-emitting modules 13 on the fixture body 12, the three light-emitting modules 13 are arranged on the inner-side light emitting module arrangement portions 25*a*, and then the other three light-emitting modules 13 are arranged on the opening-side light-emitting module arrangement portions 25*b*. Here, the connectors 38 of the light-emitting modules 13 are directed to the space 29 side formed at the center area of the fixture body 12. A thermal-conductive sheet, or silicone resin or epoxy resin excellent in thermal conductivity may be interposed between the light-emitting module 13 and each of the light-emitting module arrangement portions 25*a* and 25*b*.

By arranging the light-emitting modules 13 on the light-emitting module arrangement portions 25*a* and 25*b*, the groove portions 39, which are located at the outer diameter side of the fixture body 12, of the substrate 34 of each of the light-emitting modules 13 are fitted and positioned on the projections 27 of each of the light-emitting module arrangement portions 25*a* and 25*b*, an end, which is located at the inner diameter side of the fixture body 12, of the substrate 34 of each of the light-emitting modules 13 and an end of the substrate 34 of the adjoining light-emitting modules 13 are stacked when viewed from the opening portion 24 of the fixture body 12, and the groove portions 39 of these stacked substrates 34 of the light-emitting modules 13 are arranged substantially concentrically with the light-emitting module attachment screw holes provided on the fixture body 12. The screw 28 is screw-engaged with the light-emitting module attachment screw hole, which is provided in the fixture body 12, through the groove portions 39 of the stacked substrates 34 of the light-emitting modules 13, and the stacked substrates 34 of the two light-emitting modules 13 are arranged so that these are commonly fastened and temporarily locked to the fixture body 12 with the screw 28.

The plurality of light-emitting modules 13 arranged on the light-emitting module arrangement portions 25 of the fixture body 12 are annularly arranged in a circumferential direction so that the space 29 is formed at the center of the lower face of the substrate portion 21, that is, the center among a plurality of the light-emitting modules 13.

As shown in FIG. 3, the connector 38 of the light-emitting module 13 is connected to a connector 40*a* of a wire 40. Moreover, in FIG. 3, only the wire 40 connected to the connector 38 of one light-emitting module 13 is shown and the other wires are omitted. The wire 40 is connected to the light-emitting module 13 and led out from the wiring hole 30 to the outside of the fixture body 12 with use of the space 29 provided at the center among a plurality of the light-emitting modules 13. As shown in FIG. 8, the wire 40 is connected to an output terminal of the power source unit 18. Moreover, three of the six light-emitting modules 13 are connected in series to each other, and the other three thereof are connected in series, and the series portions are connected in parallel to each other, and the wires 40 are harnessed so as to be simply arranged. Moreover, reference numeral 41 in FIG. 5 denotes a wire cover for sealing the wiring hole 30, and a middle portion of the harnessed wires 40 is held between the wire cover 41 and an end of the wiring hole 30.

In the embodiment, the six light-emitting modules 13 each emitting light having a total luminous flux of 1000 lm are used and arranged at intervals of 60° on the fixture body 12 sc that light having a total luminous flux of 6000 lm required as the lighting fixture 10 is emitted.

Figure 4:
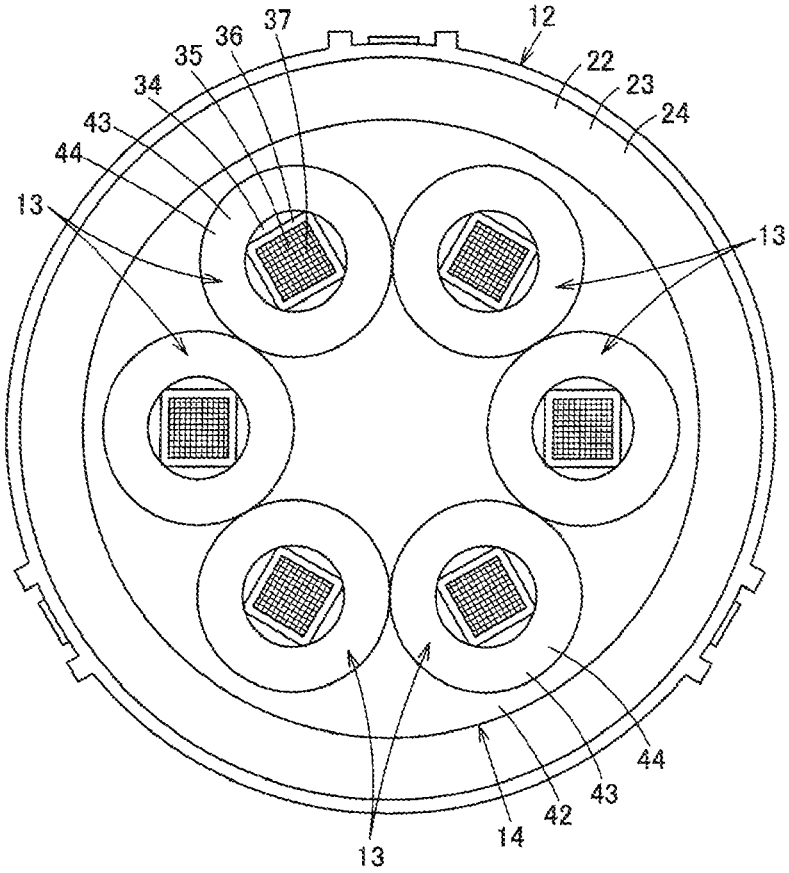
FIG. 4 shows a reflection body of the lighting fixture, FIG. 4(*a*) is a bottom view of the lighting fixture in which the reflection body is attached to the fixture body, and FIG. 4(*b*) is a cross sectional view of the reflection body.
Figure 4:
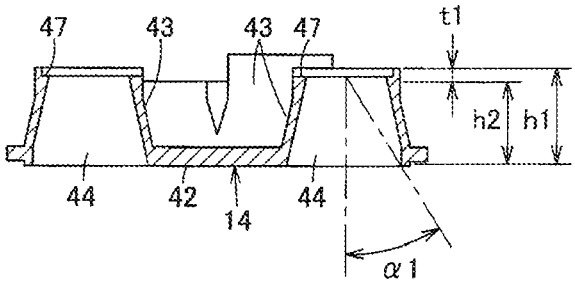
Figure 5:
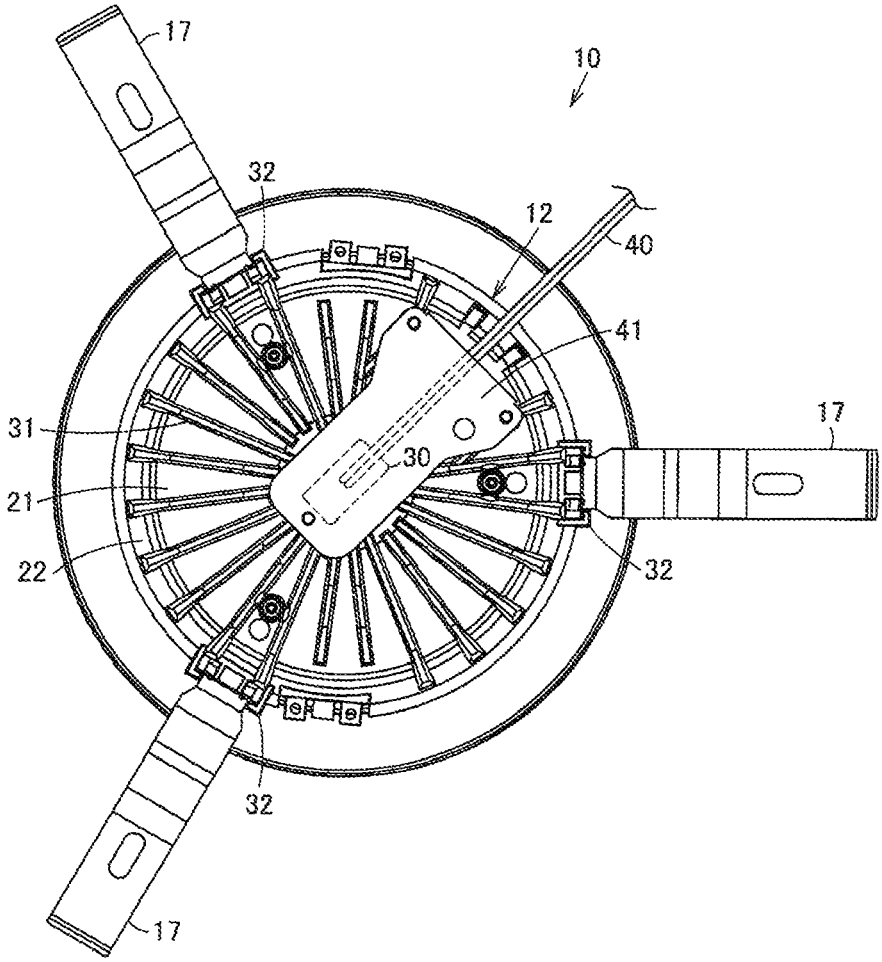
FIG. 5 is a plan view of the lighting fixture.
Figure 6:
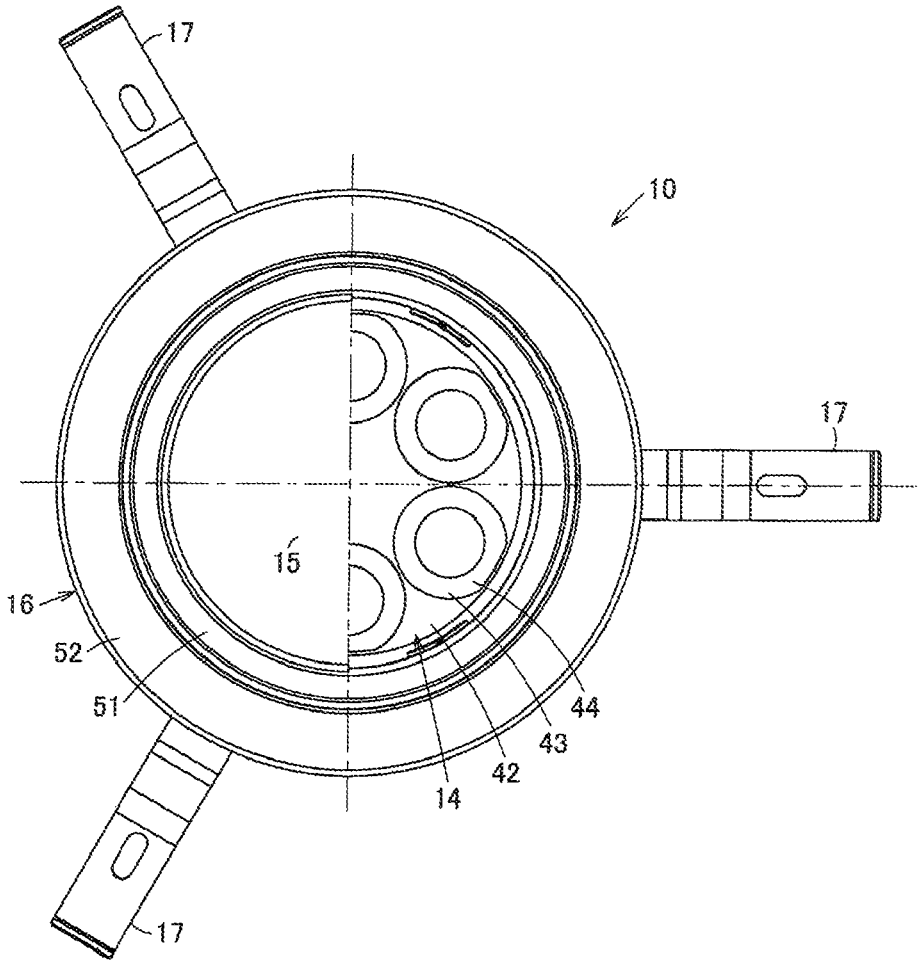
FIG. 6 is a bottom view of a partially cutaway cover of the lighting fixture.
Figure 7:
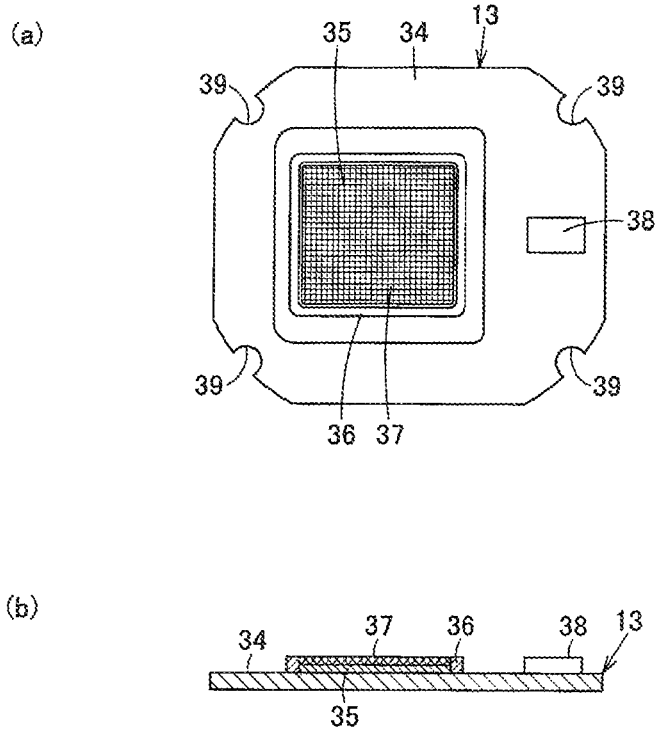
FIG. 7 schematically shows the light-emitting module of the lighting fixture, FIG. 7(*a*) is a front view of the light-emitting module, and FIG. 7(*b*) is a cross sectional view of the light-emitting module.

As shown in FIGS. 1, 2 and 4, the reflection body 14 is made of, for example, synthetic resin such as PBT (polybutylene terephthalate) having insulativity, and includes a disc-shaped surface portion 42 and a plurality of reflection cylindrical portions 43 which are projected from a circumferential portion of an upper face of the surface portion 42 so as to correspond to positions of the light-emitting modules 13 arranged on the fixture body 12. These reflection cylindrical portions 43 are nearly cylindrically formed so that the diameters become longer near the lower side of the opening portion 24. A reflecting face 44 for reflecting light, which is emitted from the LED elements 35, downward (irradiating direction) is constituted by an inner face of the reflection cylindrical portions 43. The inner diameter of a tip of an upper end side of the reflecting face 44 is longer than the outer diameter of the surrounding portion 36 of the light-emitting module 13, and the reflecting face 44 is arranged so as to face the periphery of the surrounding portion 36 of the light-emitting module 13. That is, the tip of the upper end side of the reflecting face 44 is located higher than the surface of the phosphor layer 37, which is the light-emitting surface of the light-emitting module 13, and the reflecting face 44 is provided so as to face a peripheral face of the surrounding portion 36. Moreover, at least a lower face of the surface portion 42 and the reflecting face 44 are subjected to reflecting face treatment for raising the reflection efficiency of a mirror face, a white face, etc.

A plurality of bosses 45 are projected from the upper face of the surface portion 42, screws 46 to be inserted from above the substrate portion 21 of the fixture body 12 are screw-engaged with the bosses 45, and the reflection body 14 is pulled toward and tightened to the fixture body 12. Thus, a tip of an upper end side of each reflection cylindrical portion 43 is brought into contact with the substrate 34 of each light-emitting module 13 and pressed against each light-emitting module arrangement portion 25 of the fixture body 12. That is, the tips of the upper end sides of the reflection cylindrical portions 43 are formed as a plurality of substrate pressing portions 47, and it is constituted so that each light-emitting module 13 is held between each substrate pressing portion 47 and each light-emitting module arrangement portion 25 of the fixture body 12.

The substrate pressing portion 47 is brought into contact with the substrate 34 at the periphery of the surrounding portion 36 of the light-emitting module 13. Since the connector 38 is mounted on the substrate 34 at the periphery of the surrounding portion 36 of the light-emitting module 13, a notch portion 48 for preventing the substrate pressing portion 47 from interfering with the connector 38 is formed in the substrate pressing portion 47.

Moreover, as shown in FIG. 4(*b*), height h1 of the reflection cylindrical portion 43 corresponding to the light-emitting module 13 arranged on the inner-side light-emitting module arrangement portion 25*a* is formed so as to be larger than height h2 of the reflection cylindrical portion 43 corresponding to the light-emitting module 13 arranged on the opening-side light-emitting module arrangement portion 25*b* by the level difference t1 between the light-emitting module arrangement portions 25*a* and 25*b* (h1−h2=t1).

The reflection cylindrical portion 43 of the reflection body 14 is provided for each light-emitting module 13, and thus a light distribution angle can be set to a predetermined angle. That is, as shown in FIG. 4(*b*), a light distribution angle α1 of the LED element 35 is set based on the height and the opening size of each reflection cylindrical portion 43. In the embodiment, a target light distribution angle as a downlight can be set to a middle light distribution angle, approximately 60° (α1≈30°).

Figure 9:
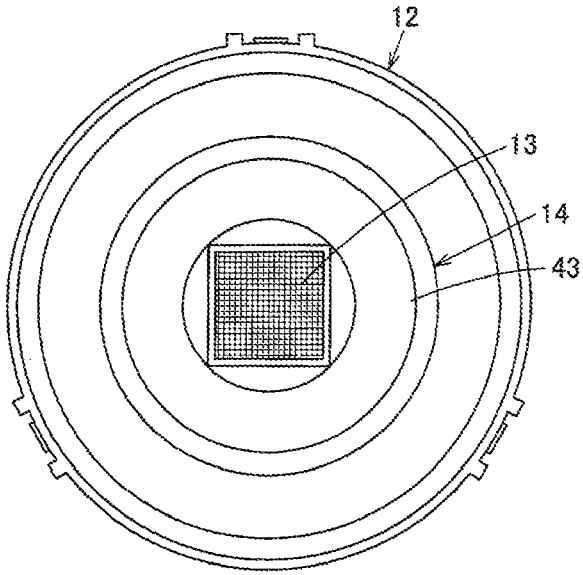
FIG. 9 is a view corresponding to FIG. 4 with respect to a lighting fixture of a comparison example, FIG. 9(*a*) is a bottom view of the lighting fixture from which a frame member and a cover member are removed, and FIG. 9(*b*) is a cross sectional view of a reflection body.
Figure 9:
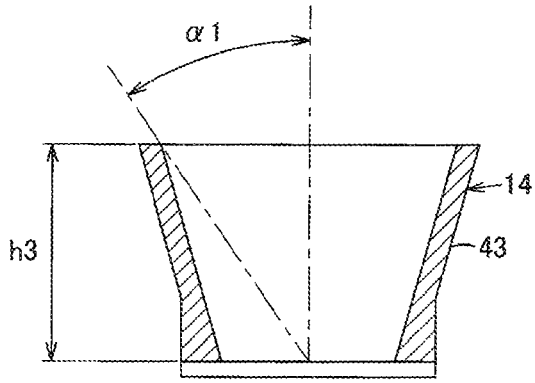

As a comparison example, alighting fixture 10 using one large light-emitting module 13 is shown in FIG. 9. Moreover, in FIG. 9 showing the comparison example, the same symbols are attached to the same portions as those of the embodiment and detailed description thereof will be omitted. In the comparison example, since it is necessary for setting a middle light distribution angle of 60° to set the height of the reflection cylindrical portion 43 to h3 larger than the height h1 of the embodiment (h1<h3), the reflection body 14 is upsized, particularly, in height and the lighting fixture 10 cannot be downsized. Accordingly, with the light-emitting modules 13 being disposed in a divided and dispersed arrangement, the height of the reflection body 14 for controlling the light distribution angle can be reduced and upsizing of the lighting fixture 10 can be suppressed.

The light-transmissive cover 15 is made of acryl resin or glass having light-transmissivity and light-diffuseness, formed in the shape of a disc capable of covering the whole of a surface side of the reflection body 14 and can be attached to/detached from the reflection body 14 by an attaching structure (not shown).

The reflection frame 16 is made of, for example, metal or synthetic resin and cylindrically shaped, and includes a reflecting face portion 51 arranged along an inner wall face of the housing portion 23 of the fixture body 12, and an edge portion 52 which comes into contact with a lower face of the ceiling member 11, holds the ceiling member 11 between the edge portion and the attachment springs 17 and covers the embedding hole 11*a*. An upper end side of the reflecting face portion 51 is attached to the fixture body 12 via screws 53. The reflecting face portion 51 is subjected to the reflecting face treatment for raising reflection efficiency of a mirror face, a white face, etc.

For example, a plate spring is used as the attachment spring 17, one end of the attachment spring 17 is attached to the attachment spring attaching portion 32 of the fixture body 12, and the other end thereof is projected sideward from the fixture body 12. As shown in FIG. 8, reaction force against elastic deformation of each attachment spring 17 is generated by elastically deforming each attachment spring 17 along a side face of the fixture body 12 and inserting the fixture body 12 into the embedding hole 11*a* of the ceiling member 11 from below, and thus each attachment spring 17 is developed sideward to come into contact with an upper face of the ceiling member 11 so that the fixture body 12 is pulled up and kept by the ceiling member 11 held between the attachment springs 17 and the edge portion 52 of the reflection frame 16 that comes into contact with the lower face of the ceiling member 11.

In addition, as shown in FIG. 8, the wire 40 led out from each light-emitting module 13 to the outside of the fixture body 12 through the wiring hole 30 is connected to the output terminal of the power source unit 18.

In the thus constituted lighting fixture 10, lighting power is supplied from the power source unit 18 to each light-emitting module 13, and thus the LED elements 35 of each light-emitting module 13 are lit and light is emitted from the light-emitting surface which is the surface of the phosphor layer 37. A part of the emitted light, directly advances to the light-transmissive cover 15, another part thereof is reflected on the reflecting surface 44 and advances to the light-transmissive cover 15, and the light transmits through the light-transmissive cover 15 and is irradiated downward from the opening portion 24.

Here, the six light-emitting modules 13 each emitting light having a total luminous flux of 1000 lm are used and light having a total luminous flux of 6000 lm required as the downlight is emitted for lighting. At the same time, the six light-emitting modules 13 can evenly emit light to the periphery because the light-emitting modules are annularly disposed at substantially even intervals so that the space 29 is formed at the center among the light-emitting modules 13. Light emitted from each light-emitting module 13 can be controlled by each reflection cylindrical portion 43 of the reflection body 14 so as to have a predetermined distribution angle.

Heat generated by lighting of the LED elements 35 of each light-emitting module 13 is conducted to the fixture body 12 through the substrate 34, and radiated into air from an outer surface including the heat radiating fins 31 of the fixture body 12.

As for the heat radiation action, since the six light-emitting modules 13 are annularly disposed on the fixture body 12 at substantially even intervals, heat generated from the light-emitting modules 13 is not concentrated at the center area of the fixture body 12, is substantially evenly dispersed to the whole of the fixture body 12 and thus can be efficiently radiated from the fixture body 12. At the same time, the heat is radiated from the reflection frame 16 fixed to the fixture body 12. The heat radiation action allows heat generated from each light-emitting module 13 to be sufficiently and effectively radiated.

As described above, according to the embodiment, a small lighting fixture 10 which can emit a large amount of light can be provided, the light having a total luminous flux of 6000 lm required as a downlight fixture, with use of six light-emitting modules 13 each emitting light having a total luminous flux of 10001 ml.

Since the plurality of light-emitting modules 13 are dispersedly disposed on the fixture body 12, light can be substantially evenly radiated to the periphery and heat generated from the light-emitting modules 13 can be dispersed and conducted to the fixture body 12 side. Since the heat generated from the light-emitting modules 13 is not concentrated at the center area of the fixture body 12 and is substantially evenly dispersed to the whole of the fixture body 12, the heat can be efficiently radiated from the fixture body 12. Since the light-emitting modules 13 are dispersedly disposed, the height of the reflection body 14 for controlling the light distribution angle can be reduced. According to these effects, a small lighting fixture 10 which, without upsizing, obtains necessary heat radiation performance and a predetermined light distribution performance and thus emits a large amount of light can be provided.

Since the plurality of light-emitting modules 13 are annularly disposed so that the space 29 is formed at the center among the light-emitting modules 13 and the wiring connector 38 is arranged at the space 29, which is located at the center side of the light-emitting module 13, light emitted from each light-emitting module 13 can be evenly radiated to the periphery, the wires 40 can be connected to the connectors 38 of the light-emitting modules 13 with use of the space 29 located at the center, and a specific wiring space is not required. Thus, a small lighting fixture 10 emitting a large amount of light can be provided.

Since a part of the substrates 34 of the adjoining light-emitting module 13 overlap, the plurality of light-emitting modules 13 can be efficiently disposed on a limited space in the fixture body 12, and a smaller lighting fixture 10 emitting a large amount of light can be provided.

Since each substrate pressing portion 47 provided in the reflection body 14 is brought into contact with the substrate 34 of each light-emitting module 13 and the substrate 34 can be held between the substrate pressing portion 47 and each light-emitting module arrangement portion 25 of the fixture body 12, it is unnecessary to attach each light-emitting module 13 to the fixture body 12 with a plurality of screws, the number of parts can be reduced and assembling workability can be improved. That is, the number of the screws 28 used for temporary locking may be the same as that of the light-emitting modules 13. In addition, the screw 28 is not indispensable, and the light-emitting module 13 can be reliably held between the reflection body 14 and the fixture body 12 even without the screw 28.

Since each reflecting face 44 of the reflection body 14 is provided so as to face the peripheral face of the surrounding portion 36 of each light-emitting module 13, light leakage to the periphery of the light-emitting module 13 can be suppressed and light extraction efficiency of extracting light, which is emitted from the light-emitting modules 13, at the reflection body 14 can be improved.

Since each substrate pressing portion 47 of the reflection body 14 is brought into contact with the substrate 34 at the periphery of the surrounding portion 36 of the light-emitting module 13, a portion, which is located inside the surrounding portion 36 and on which the LED elements 35 are mounted, of the substrate 34 can be reliably brought into close contact with the fixture body 12 and thermal conductivity from the substrate 34 to the fixture body 12 can be improved.

Since the notch portion 48 is provided in each substrate pressing portion 47 of the reflection body 14, the substrate 34 can be reliably held between the reflection body 14 and the fixture body 12 while the portion 47 is prevented from interfering with the connector 38 arranged on the substrate 34 of each light-emitting module 13.

Since the level difference is formed between the adjacent light-emitting module arrangement portions 25 of the fixture body 12 and the substrates 34 of the adjoining light-emitting modules 13 can be arranged on the adjacent light-emitting module arrangement portions 25 so as to overlap with each other when viewed from the opening portion 24 side of the fixture body 12, more light-emitting modules 13 can be arranged on a limited space of the fixture body 12, the brightness can thus be raised, and an insulation distance between the adjoining light-emitting modules 13 can be secured by the provided level difference. That is, while the insulation distance between the adjoining light-emitting modules 13 is secured by the provided level difference, more light-emitting modules 13 are arranged on the limited space of the fixture body 12 and the brightness can be improved.

In addition, since portions, which overlap each other, of the substrates 34 of the adjoining light-emitting modules 13 can be commonly fastened and temporarily locked to the fixture body 12 with the screw 28, the number of necessary screws 28 can be reduced.

Further, level differences are also formed between the adjacent reflecting faces 44 of the reflection body 14 and between the adjacent substrate pressing portions 47 thereof respectively so as to correspond to the level difference between the adjacent light-emitting module arrangement portions 25 of the fixture body 12.

Figure 10:
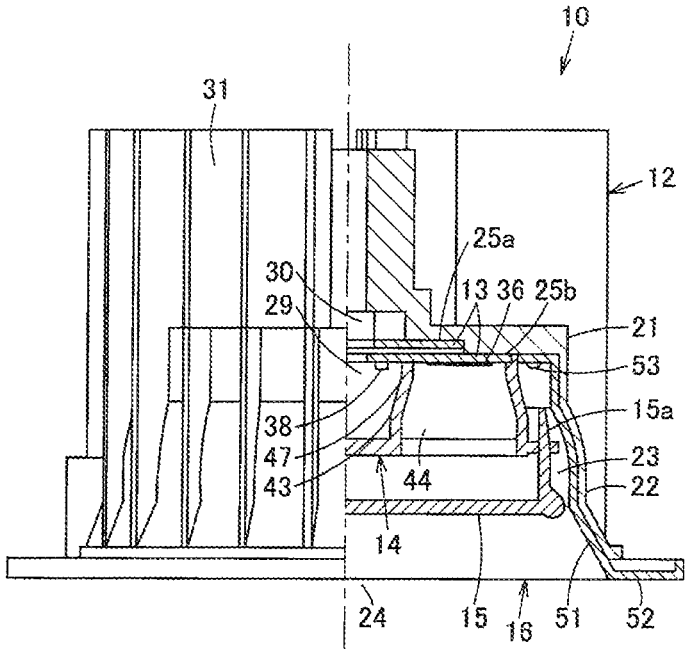
FIG. 10 shows a lighting fixture of a second embodiment, FIG. 10(*a*) is a cross sectional view of the lighting fixture, and FIG. 10(*b*) is a cross sectional view of the partially enlarged lighting fixture.
Figure 10:
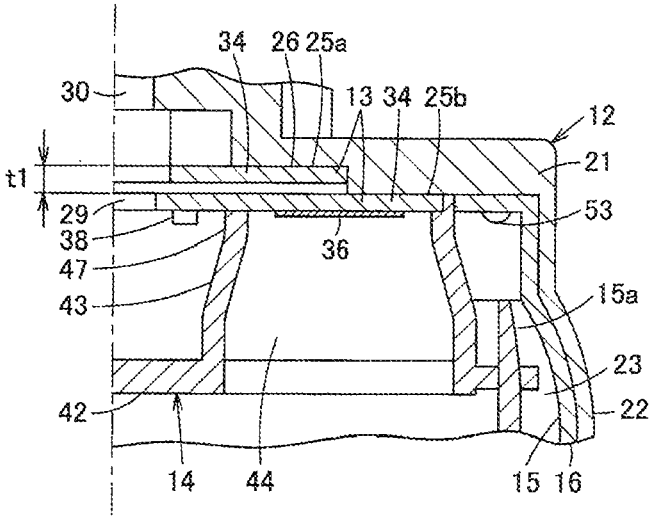

Next, a second embodiment will be described with reference to FIG. 10. Moreover, the same reference symbols are attached to the same structures as those of the first embodiment, and description thereof will be omitted.

The substrate pressing portion 47 of the reflection body 14 is brought into contact with the substrate 34 at the whole periphery of the surrounding portion 36 of the light-emitting module 13. The connector 38 is here arranged at a position outside of the substrate pressing portion 47 and does not interfere with the substrate pressing portion 47.

The substrate pressing portion 47 of the reflection body 14 is brought into contact with the substrate 34 at the whole periphery of the surrounding portion 36 of the light-emitting module 13, the substrate 34 can be evenly pressed against the fixture body 12 and thermal conductivity from the substrate 34 to the fixture body 12 can be improved.

A plurality of support legs 15*a* are integrally formed at a circumferential portion of the light-transmissive cover 15, and the light-transmissive cover 15 can be attached to the reflection body 14 via the support legs 15*a*.

Next, a third embodiment will be described with reference to FIG. 11. Moreover, the same reference symbols are attached to the same structures as those of the first embodiment, and description thereof will be omitted.

Figure 11:
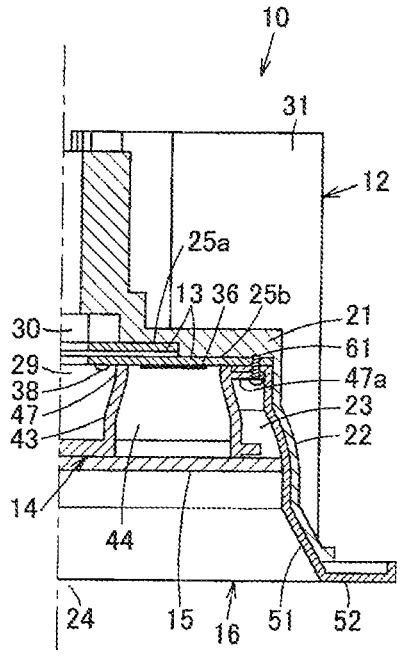
FIG. 11 shows a lighting fixture of a third embodiment, FIG. 11(*a*) is a cross sectional view of the lighting fixture of a first example, and FIG. 11(*b*) is a cross sectional view of the lighting fixture of a second example.
Figure 11:
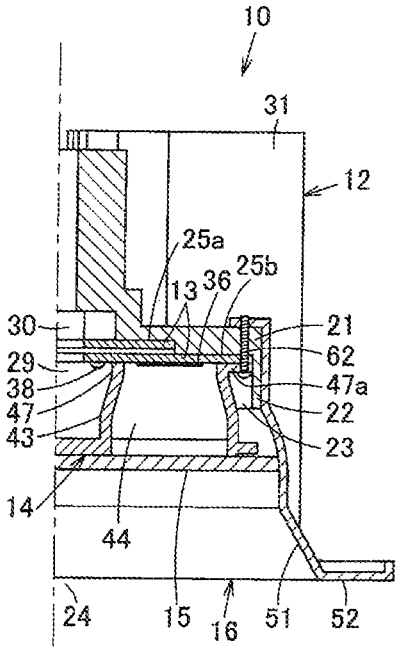

Regarding the third embodiment, first and second examples of attachment structure of the light-emitting module 13, the reflection body 14 and the reflection frame 16 to the fixture body 12 are shown in FIGS. 11(*a*) and 11(*b*) respectively.

As shown in FIG. 11(*a*), in the first example, the substrate 34 of the light-emitting module 13 is brought into close contact with the light-emitting module arrangement portion 25 of the fixture body 12, the reflection frame 16 is brought into close contact with the substrate 34 of the light-emitting modules 13, and a flange portion 47*a* projected from the substrate pressing portion 47 is brought into close contact with the reflection frame 16. The flange portion 47*a*, the reflection frame 16, the substrate 34 and the fixture body 12 are integrally fastened to each other with a screw 61.

According to this structure, the substrates 34 of the light-emitting modules 13 and the reflection frame 16 can be held between the reflection body 14 and the fixture body 12, heat generated from the light-emitting modules 13 can be efficiently conducted to the reflection frame 16 and heat radiation performance can be improved. Since all the components are held and fixed, close contact performance, heat shock performance and assembling performance can be improved.

As shown in FIG. 11(*b*), in the second embodiment, the reflection frame 16 is brought into close contact with an upper face side of the fixture body 12, the substrate 34 of the light-emitting module 13 is brought into close contact with the light-emitting module arrangement portion 25 of the fixture body 12, and the flange portion 47*a* projected from the substrate pressing portion 47 is brought into close contact with the substrate 34 of the light-emitting module 13. The flange portion 47*a*, the substrate 34, the fixture body 12 and the reflection frame 16 are integrally fastened to each other with the screw 61.

According to this structure, the substrates 34 of the light-emitting modules 13 and the reflection frame 16 can be held between the reflection body 14 and the fixture body 12, heat generated from the light-emitting modules 13 can be efficiently conducted to the reflection frame 16 and the heat radiation performance can be improved. Since all the components are held and fixed, the close contact performance, the heat shock performance and the assembling performance can be improved.

Since such a lighting fixture 10, in the future, will be further required to emit a large amount of light in the structures shown in FIGS. 11(*a*) and 11(*b*), the LED elements 35 of the light-emitting module 13 are required to be mounted at higher density and more effective heat radiation performance is necessary. The structure is effective that heat generated from the light-emitting modules 13 can be effectively conducted to the reflection frame 16 and radiated.

Figure 12:
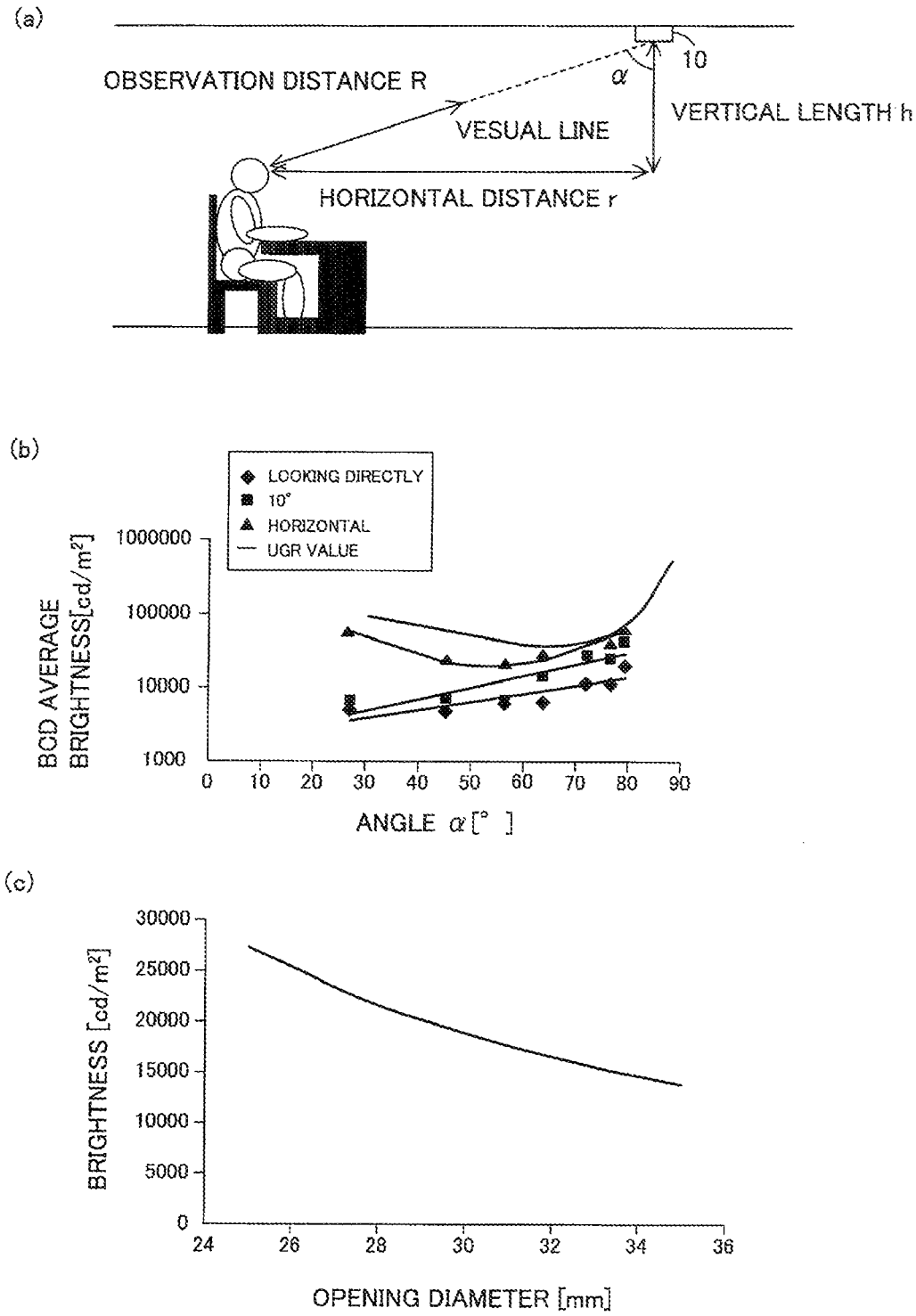
FIG. 12 shows experiment data of a lighting fixture of a fourth embodiment, FIG. 12(*a*) is an explanatory view of experimental conditions, FIG. 12(*b*) is a graph showing a relationship between the angle and the BCD average brightness, and FIG. 12(*c*) is a graph showing a relationship between the opening diameter and the brightness.

Next, a fourth embodiment will be described with reference to FIG. 12. Moreover, the same reference symbols are attached to the same structures as those of the first embodiment, and description thereof will be omitted.

Regarding a small downlight type lighting fixture 10 emitting a large amount of light, the fixture 10 being constituted similarly to that of the first embodiment, the opening area of the reflection body 14 is calculated so that a predetermined middle angle light distribution can be obtained while glare is suppressed.

In the embodiment, in the lighting fixture 10 which can be installed in the embedding hole 11*a*, which has a diameter of approximately 150 mm, of the ceiling member 11, light distribution is set to middle angle light distribution that the total luminous flux of the fixture is 4000 lm or more and the light distribution angle is 60°. Further, the total opening area of the reflection body 14 is set within a range of 4000-6000 $mm^2$. Specifically, the opening diameters at a light emission side of the six reflection cylindrical portions 43 of the reflection body 14 are set within a range of 29.5-36 mm. In the thus constituted lighting fixture 10, the predetermined middle angle light distribution can be obtained while glare is suppressed.

For example, regarding a downlight type lighting fixture 10 that the total luminous flux of the six light-emitting modules 13 (each having a total luminous flux of 800 lm) is 4800 lm, the total luminous flux of the fixture is 4400 lm and the light distribution angle is 60°, the reflection body 14 is required, for realizing a light distribution angle of 60°, to have reflection performance similar to that of a mirror face. However, glare easily occurs. According to the data shown in FIG. 12(*b*), the BCD average brightness (average brightness of the whole lighting fixture) in the case of being viewed from a horizontal direction has a minimum value, approximately 20000 cd/$m^2$, at a vertical angle of 55°. When a baffle having a shielding angle of, for example, 30° is used for the lighting fixture 10, light having a vertical angle of 60° or larger is shielded, however, light having a vertical angle of 55° cannot be shielded and glare easily occurs. Moreover, FIG. 12(*a*) shows experimental conditions, and FIG. 12(*b*) is a graph, as experiment data, indicating a relationship between an angle $\alpha$ and the BCD average brightness (a background brightness of 50 [cd/$m^2$]).

Regarding a downlight type lighting fixture 10 that the total luminous flux of the fixture is 4000 lm and the light distribution angle is 60°, the opening diameter of the reflection cylindrical portion 43 of the reflection body 14 is changed and the brightness at a vertical angle of 55° is measured. The graph in FIG. 12(*c*) indicates the measurement results. It is understood that the opening diameter of the reflection cylindrical portion 43 is required to be set to approximately 29.5 mm or longer for obtaining a brightness of 20000 cd/$m^2$ at a vertical angle of 55°. Consequently, it is understood that the total opening area of the reflection body 14 is preferably 4000 $mm^2$ or larger.

On the other hand, the diameter of the reflection body 14, which is used for the lighting fixture 10 capable of being installed in the embedding hole 11*a*, which has a diameter of approximately 150 mm, of the ceiling member 11, is approximately 120 mm. The maximum opening diameter of the reflection cylindrical portion 43 is approximately 36 mm so that the six reflection cylindrical portions 43 can be housed in the reflection body 14. Thus, the total opening area of the reflection body 14 is preferably 6000 $mm^2$ or smaller.

As described above, by setting the total opening area of the reflection body 14 within a range of 4000-6000 $mm^2$, a predetermined middle angle light distribution can be obtained while glare is suppressed. With this, in particular, the small downlight type lighting fixture 10 emitting a large amount of light, the fixture 10 using the six light-emitting modules 13 each emitting light having a total luminous flux of 1000 lm and emitting light having a total luminous flux of 6000 lm required as the downlight type lighting fixture, the above setting is particularly effective for suppressing glare. In a conventional downlight type lighting fixture, the embedding hole 11*a* is 150 mm in diameter and the total luminous flux is approximately 2000 lm or less. However, when the total luminous flux of the conventional fixture is set to 4000 lm or more for emitting a large amount of light, glare easily occurs. Accordingly, it is extremely effective for suppressing glare to adopt the above-described constitution.

Next, a fifth embodiment will be described with reference to FIG. 13. Moreover, the same reference symbols are attached to the same structures as those of the first embodiment, and description thereof will be omitted.

In the small downlight type lighting fixture 10 emitting a large amount of light, the fixture being constituted similarly to that of the first embodiment, some of the six reflection cylindrical portions 43 of the reflection body 14 are displaced in an optical axis x-x direction, and thus glare is suppressed while a predetermined middle angle light distribution is obtained.

Figure 13:
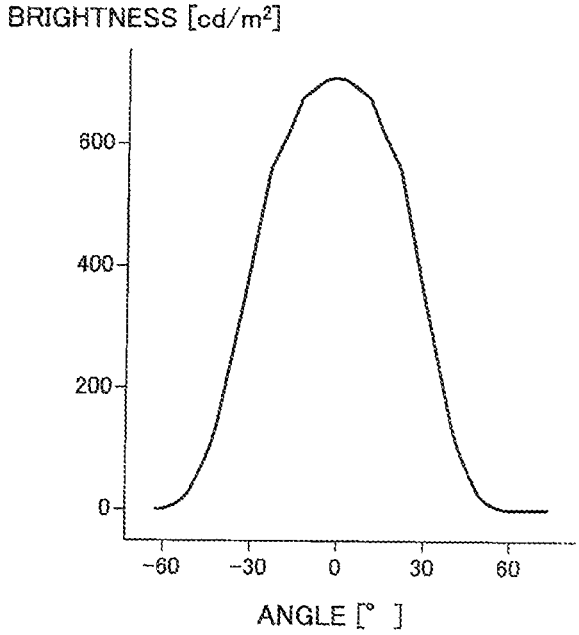
FIG. 13 indicates experiment data of a lighting fixture of a fifth embodiment, FIG. 13(*a*) indicates a light distribution curve of a downlight, and FIG. 13(*b*) is an explanatory view showing an angle difference in the case where a person in a room visually recognizes a reflection body having difference stages.
Figure 13:
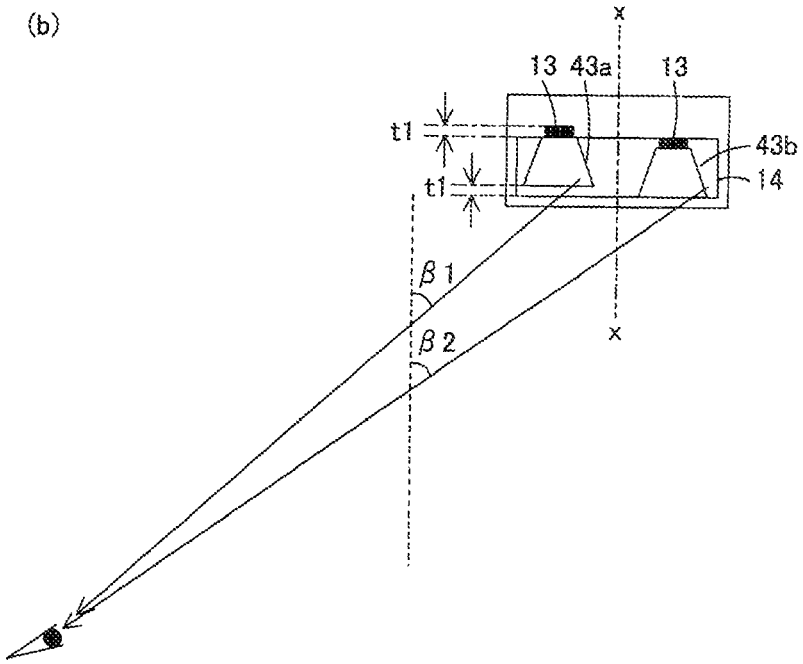

Specifically, as shown in FIG. 13(*b*), three of the six reflection cylindrical portions 43 of the reflection body 14, reflection cylindrical portions 43*b*, and the other three thereof, reflection cylindrical portions 43*a*, are displaced from each other in the optical axis x-x direction by the level difference t1.

As shown in FIG. 13(*a*) indicating a light distribution example regarding the downlight type lighting fixture 10 having a middle light distribution angle of 60°, an inclination of the brightness is large in the vicinity of a light emission angle of 30° to 50°. In addition, as shown in FIG. 13(*b*), in the case where the ceiling is 2.4 m in height, when a person in a room is located in the vicinity of alight emission angle of 50° looks at the lighting fixture 10, an angle difference of approximately 0.5° (angle $\beta 2-\beta 1 \approx 0.5°$) is generated between the reflection cylindrical portions 43*a* and 43*b* having difference heights. In the light distribution example in FIG. 13(*a*), an angle difference of 0.5° in the vicinity of a light emission angle of 50° corresponds to a brightness change rate of 10-15%. That is, when, for example, three of the six reflection cylindrical portions 43 of the reflection body 14, the three reflection cylindrical portions 43*b*, and the other three thereof, the reflection cylindrical portions 43*a*, are displaced from each other in the optical axis x-x direction by the level difference t1, the brightness is reduced by 5-7% in the optical axis x-x.

As described above, by displacing some of the six reflection cylindrical portions 43 of the reflection body 14 from the others in the optical axis x-x direction, glare can be suppressed while the predetermined middle angle light distribution is obtained. This displacement is particularly effective for suppressing glare regarding the small downlight type lighting fixture 10 emitting a large amount of light, the fixture using the six light-emitting modules 13 similar to that of the first embodiment.

Next, a sixth embodiment will be described. Moreover, the same reference symbols are attached to the same structures as those of the first embodiment, and description thereof will be omitted.

In the embodiment, regarding a small downlight type lighting fixture 10 emitting a large amount of light, the fixture 10 with the embedding hole 11*a* having a diameter of approximately 150 mm and having a total luminous flux 2000 lm or more, the light emission area of a light-emitting portion which obtains necessary heat radiation performance and a predetermined light distribution and can obtain a target total luminous flux without upsizing of the fixture was calculated.

Regarding the embodiment, as described below, the rate of the total light emission area of light-emitting surfaces of the six light-emitting modules 13 to the opening area of the fixture body 12 is set within a range of 4.25-15%. When the rate of the total light emission area exceeds the above range, the opening area of the fixture body 12 is required to be further increased for heat radiation, in particular, the height of the fixture body 12 is increased, the fixture cannot be downsized, and it becomes difficult to obtain a suitable light distribution angle. In addition, when the rate of the total light emission area is smaller than the above range, it becomes difficult to obtain the target total luminous flux. In consideration of the above facts, a rate of 4.25-15% is preferable, and more preferably, the rate is 4.5-15%. Thus, the small downlight type lighting fixture 10 having a total luminous flux 2000 lm or more and emitting a large amount of light is not upsized, obtains the necessary heat radiation performance and the predetermined light distribution, and can obtain the target total luminous flux.

The above-described rate of the total light emission area to the opening area of the fixture body 12 is calculated as described below.

The diameter of the opening portion 24 of the lighting fixture 10 to be installed in the embedding hole 11*a* having a diameter of 150 mm is set to approximately 104 mm, and the opening area is set to approximately 8491 $mm^2$. In a conventional LED downlight the total luminous flux of which is approximately 2000 lm, for example, 26 SMD type LEDs each having a diameter of approximately 4.2 mm are used as a light source. In the LED downlight, the total light emission area is approximately 360 $mm^2$, and the rate thereof to the opening area is approximately 4.24%.

The downlight type lighting fixture 10 of the first embodiment can emit light having a total luminous flux of approximately 60001-9000 lm, the light-emitting surface of one light-emitting module 13 is a square of which one side is approximately 15 mm in length, and the total light emission area of the six light-emitting modules 13 is approximately 1350 $mm^2$. When the opening portion 24 of the fixture body 12 is 108 mm in diameter and 9156 $mm^2$ in opening area, the rate of the total light emission area of the six light-emitting modules 13 to the opening area of the fixture body 12 is approximately 15%.

Moreover, considering the diameter of the embedding hole 11*a* as a reference, since an opening end, from which light is emitted, of the lighting fixture 10 to be installed in the embedding hole 11*a* having a diameter of 150 mm is approximately 135 mm in length, the rate of the total light emission area of the six light-emitting modules 13 to the opening area is optimally within a range of 2.5% to 9.5%.

Consequently, regarding the small downlight type lighting fixture 10 having a total luminous flux of 2000 lm or more and emitting a large amount of light, the light emission area of the light-emitting portion which obtains the necessary heat radiation performance and the predetermined light distribution and can obtain the target total luminous flux without upsizing of the fixture can be calculated. The light emission area is particularly important for the small downlight type lighting fixture 10 using the six light-emitting modules 13 and emitting a large amount of light as in the first embodiment.

Moreover, the semiconductor light-emitting element of the light-emitting module 13 is not limited to the LED element, and an EL element, a semiconductor laser, etc., are adoptable as the semiconductor light-emitting element. In addition, the light-emitting module 13 is not limited to the COB (Chip On Board) module in which a plurality of LED elements are mounted on a substrate, and a module in which an SMD (Surface Mount Device) package, on which one LED chip is loaded, with connection terminals is mounted on a substrate is adoptable as the light-emitting module 13.

When a part of the adjoining light-emitting modules 13 overlap and are disposed on the fixture body 12, it is preferable that parts, which do not emit light, of the adjoining substrates 34 are stacked so that light-emitting portions of the adjoining light-emitting modules 13 do not overlap. However, the light-emitting portions may partially overlap as long as light emission performance is not impaired.

The substrate pressing portion 47 of the reflection body 14 may serve as a portion forming the reflecting face 44, or may be provided away from the portion forming the reflection face 44.

Regarding the level difference between the adjacent light-emitting module arrangement portions 25 of the fixture body 12, for example, the light-emitting module arrangement portions 25 may be mutually high and low in an adjacent direction, or may become sequentially lower or higher in one direction.

Although the power source unit 18 is provided away from the fixture body 12 in the embodiments, it may be provided integrally therewith so that an integration-type lighting fixture 10 is constituted.

In addition, the lighting fixture is applicable not only to a downlight but also to a spotlight.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A lighting fixture comprising:

a fixture body having a plurality of light-emitting module arrangement portions on a surface thereof; and a plurality of light-emitting modules each having a substrate on which a semiconductor light-emitting element and a wiring connector are disposed, the plurality of light-emitting modules being arranged on the light-emitting module arrangement portions of the fixture body such that the light-emitting modules surround a center area of the fixture body and the wiring connectors face the center area, wherein the light-emitting module arrangement portions are disposed at a plurality of levels relative to an optical axis of the lighting fixture and the plurality of the light-emitting modules are arranged on the plurality of levels so that a part of at least one of the plurality of light-emitting modules on the fixture body overlaps a part of at least one other of the plurality of light-emitting modules on the fixture body in a direction parallel to the optical axis.

2. The lighting fixture according to claim 1, further comprising a reflection body which is attached to the fixture body and includes a reflecting face for reflecting light emitted from each semiconductor light-emitting element.

3. The lighting fixture according to claim 2, wherein each light-emitting module includes a bank-shaped surrounding portion for surrounding each semiconductor light-emitting element, and a phosphor layer which covers each semiconductor light-emitting element surrounded by the surrounding portion.

4. The lighting fixture according to claim 2, wherein the reflecting surface of the reflection body is provided in a position to face peripheral area of the corresponding surrounding portion.

5. The lighting fixture according to claim 4, wherein the reflection body includes a substrate pressing portion, the substrate pressing portion being brought into contact with surface of the substrates at the periphery of the surrounding portions of the light-emitting modules.

6. The lighting fixture according to claim 5, wherein the substrate pressing portion includes a notch portion for preventing an interference with the connector.

7. The lighting fixture according to claim 3, wherein the adjacent reflecting surfaces and the adjacent substrate pressing portions of the reflection body are disposed at a plurality of levels corresponding to the plurality of levels of the light-emitting module arrangement portions.

* * * * *